US010563901B2

(12) United States Patent
Boehringer et al.

(10) Patent No.: US 10,563,901 B2
(45) **Date of Patent: *Feb. 18, 2020**

(54) REFRIGERATION APPLIANCE HAVING SIDE AIR INTAKE VENT WITH SOUND DAMPENING

(71) Applicant: WHIRLPOOL CORPORATION, Benton Harbor, MI (US)

(72) Inventors: Bruno Boehringer, Benton Harbor, MI (US); Darci Cavali, Evansville, IN (US); Derek Lehman, Coralville, IA (US); Daniel J. Lesko, Kalamazoo, MI (US); Kevin Noel, Atkins, IA (US); Douglas Pohl, Davenport, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/188,380

(22) Filed: Nov. 13, 2018

(65) Prior Publication Data

US 2019/0078832 A1 Mar. 14, 2019

Related U.S. Application Data

(63) Continuation of application No. 14/982,439, filed on Dec. 29, 2015, now Pat. No. 10,126,039.

(51) Int. Cl.

| | |
|---|---|
| ***F25D 23/00*** | (2006.01) |
| ***F24F 13/24*** | (2006.01) |
| ***F24F 13/08*** | (2006.01) |

(52) U.S. Cl.
CPC ..... *F25D 23/003* (2013.01); *F24F 13/082* (2013.01); *F24F 13/084* (2013.01);
(Continued)

(58) Field of Classification Search
CPC ..... F25D 23/003; F25D 23/006
(Continued)

(56) References Cited

U.S. PATENT DOCUMENTS

| | | | |
|---|---|---|---|
| 1,769,111 | A | 7/1930 | Davenport |
| 1,849,793 | A | 3/1932 | Dennison |

(Continued)

FOREIGN PATENT DOCUMENTS

| | | | |
|---|---|---|---|
| EP | 0718570 | A2 | 6/1996 |
| EP | 2604958 | A2 | 6/2013 |

(Continued)

*Primary Examiner* — Jeremy A Luks
(74) *Attorney, Agent, or Firm* — Price Heneveld LLP

(57) ABSTRACT

A refrigeration appliance includes an insulated cabinet having a side wall and a machine compartment positioned adjacent the side wall. An aperture is provided through the first side wall to allow air to flow into the machine compartment. An air vent is provided at the exterior surface of the side wall so as to cover the aperture. The air vent having a first set of louvers. A sound barrier is provided at the interior surface of the side wall at the aperture. The sound barrier has a second set of louvers, where the second set of louvers are positioned with respect to the first set of louvers such that there is no mechanical access to components in the machine compartment through the air vent, and such that sounds from within the machine compartment are dampened while still allowing air to flow through the air vent.

20 Claims, 8 Drawing Sheets

(52) U.S. Cl.
CPC ..... *F24F 13/24* (2013.01); *F25D 23/00* (2013.01); *F25D 23/006* (2013.01); *F25B 2500/12* (2013.01); *F25D 2317/061* (2013.01); *F25D 2317/0671* (2013.01)

(58) Field of Classification Search
USPC ..... 181/200
See application file for complete search history.

(56) References Cited

U.S. PATENT DOCUMENTS

| | | | |
|---|---|---|---|
| 1,865,677 | A | 7/1932 | Cheyney |
| 1,886,607 | A | 11/1932 | Deventer |
| 2,114,200 | A | 4/1938 | Woodruff |
| 2,704,504 | A | 3/1955 | Wilkening |
| 2,838,917 | A | 6/1958 | Smithson |
| 3,061,056 | A | 10/1962 | Kodaras |
| 3,537,544 | A | 11/1970 | King |
| 5,332,872 | A | 7/1994 | Ewanek |
| 6,023,938 | A | 2/2000 | Taras et al. |
| 6,666,045 | B1 | 12/2003 | Song |
| 7,114,345 | B2 | 10/2006 | Kim et al. |
| 7,146,825 | B2 | 12/2006 | Seo |
| 7,155,926 | B2 | 1/2007 | Chae et al. |
| 8,144,465 | B2 | 3/2012 | Liang et al. |
| 8,590,337 | B2 | 11/2013 | Lafaire |
| 8,959,945 | B2 | 2/2015 | Chae et al. |
| 10,126,039 | B2 * | 11/2018 | Boehringer ..... F25D 23/003 |
| 2006/0101844 | A1 | 5/2006 | Manole |
| 2008/0230305 | A1 | 9/2008 | Goto et al. |
| 2009/0133957 | A1 | 5/2009 | Owens |
| 2010/0018798 | A1 | 1/2010 | Jeon et al. |
| 2010/0242525 | A1 | 9/2010 | Park et al. |
| 2012/0067075 | A1 | 3/2012 | Jeon et al. |
| 2013/0255305 | A1 | 10/2013 | Kim |
| 2015/0059370 | A1 | 3/2015 | Kim et al. |
| 2015/0153097 | A1 | 6/2015 | Koo et al. |

FOREIGN PATENT DOCUMENTS

| | | | |
|---|---|---|---|
| JP | 4-371783 | | 12/1992 |
| JP | H06147727 | A | 5/1994 |
| JP | H08257327 | A | 10/1996 |
| JP | H08285439 | A | 11/1996 |
| JP | 2007303791 | A | 11/2007 |
| JP | 2008-106967 | | 5/2008 |
| JP | 2011058691 | A | 3/2011 |
| KR | 2019990018697 | | 6/1999 |
| KR | 10-2007-0051528 | | 5/2007 |
| KR | 10-2008-0003668 | | 1/2008 |
| KR | 1020090100772 | | 9/2009 |
| KR | 1020120135768 | | 12/2012 |
| WO | 2014/201892 | A1 | 12/2014 |

* cited by examiner

REFRIGERATION APPLIANCE HAVING SIDE AIR INTAKE VENT WITH SOUND DAMPENING

CROSS-REFERENCE TO RELATED APPLICATION

This application is a continuation of U.S. patent application Ser. No. 14/982,439 filed Dec. 29, 2015, entitled "REFRIGERATION APPLIANCE HAVING SIDE AIR INTAKE VENT WITH SOUND DAMPENING," the entire disclosure of which is incorporated herein by reference.

BACKGROUND

The present device generally relates to a refrigeration appliance, and more specifically, to venting for a machine compartment of a refrigeration appliance.

SUMMARY

In at least one aspect, a refrigeration appliance is provided comprising: an insulated cabinet in which at least one refrigerated storage compartment and a machine compartment are provided, the cabinet including at least a first side wall, a second side wall and a back wall disposed between the first and second side walls, the first side wall including an exterior surface and an interior surface, the machine compartment being positioned adjacent the first side wall; an aperture provided through the first side wall to allow air to flow from outside the insulated cabinet into the machine compartment; an air vent provided at the exterior surface of the first side wall so as to cover the aperture, the air vent having a first set of louvers arranged such that air may flow therebetween; and a sound barrier provided at the interior surface of the first side wall at the aperture, the sound barrier having a second set of louvers arranged such that air may flow therebetween, wherein the second set of louvers of the sound barrier being positioned with respect to the first set of louvers of the air vent such that there is no mechanical access to components in the machine compartment through the air vent and the sound barrier from outside the air vent, and such that sounds from within the machine compartment are dampened to reduce resulting sound levels outside the air vent while still allowing air to flow through the air vent and the sound barrier from outside the insulated cabinet into the machine compartment.

In at least another aspect, a refrigeration appliance is provided comprising: an insulated cabinet in which at least one refrigerated storage compartment and a machine compartment are provided, the cabinet including at least a first side wall, a second side wall and a back wall disposed between the first and second side walls, the first side wall including an exterior surface and an interior surface, the machine compartment being positioned adjacent the first side wall; an aperture provided through the first side wall to allow air to flow from outside the insulated cabinet into the machine compartment; an air vent provided at the exterior surface of the first side wall so as to cover the aperture; and a sound barrier provided at the interior surface of the first side wall at the aperture, the sound barrier dampens sounds from within the machine compartment to reduce resulting sound levels outside the air vent while still allowing air to flow through the air vent and the sound barrier from outside the insulated cabinet into the machine compartment, wherein the sound barrier provides a sound power reduction of at least 5 db(A) at some octave bands.

In at least another aspect, a refrigeration appliance is provided comprising: an insulated cabinet in which at least one refrigerated storage compartment and a machine compartment are provided, the cabinet including at least a first side wall, a second side wall and a back wall disposed between the first and second side walls, the first side wall including an exterior surface and an interior surface, the machine compartment being positioned adjacent the first side wall; an aperture provided through the first side wall to allow air to flow from outside the insulated cabinet into the machine compartment; an air vent provided at the exterior surface of the first side wall so as to cover the aperture; and a sound barrier provided at the interior surface of the first side wall at the aperture, the sound barrier having a dome that is concave towards the machine compartment and convex towards the air vent, the sound barrier arranged such that sounds from within the machine compartment are dampened to reduce resulting sound levels outside the air vent while still allowing air to flow through the air vent and the sound barrier from outside the insulated cabinet into the machine compartment.

These and other features, advantages, and objects of the present device will be further understood and appreciated by those skilled in the art upon studying the following specification, claims, and appended drawings.

DETAILED DESCRIPTION OF EMBODIMENTS

Figure 1:
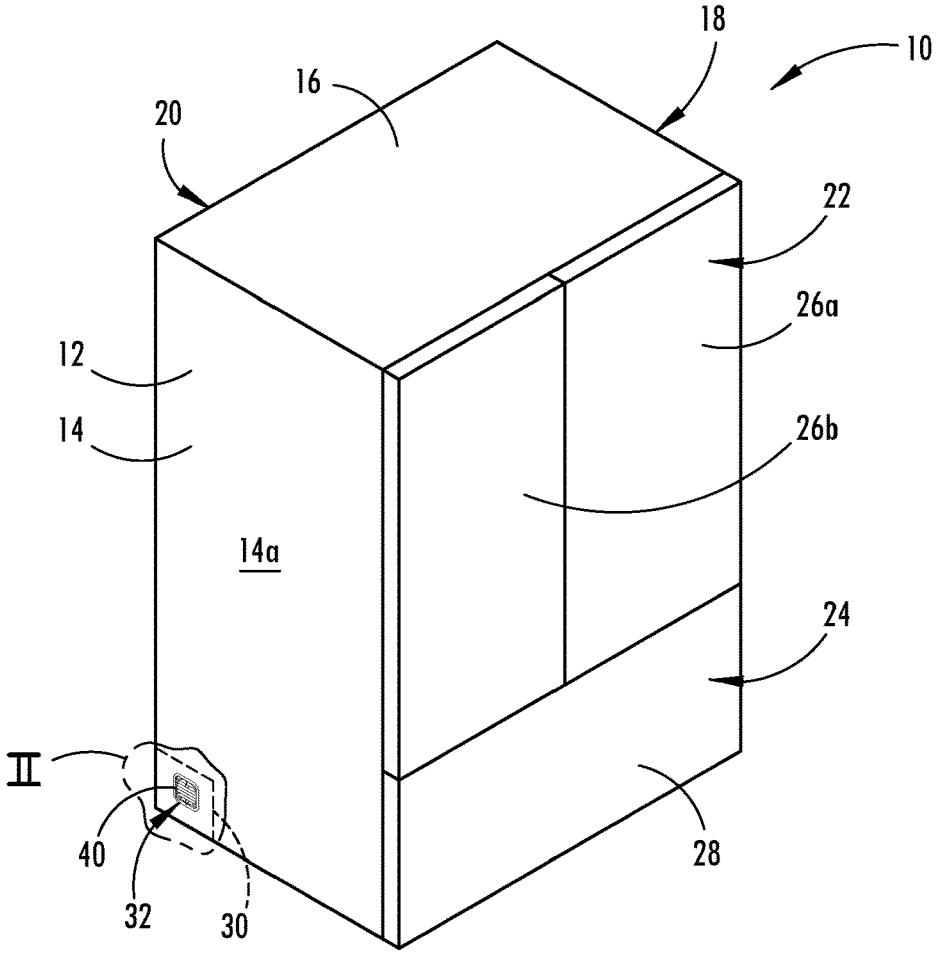
FIG. 1 is a perspective view of a refrigeration appliance.
Figure 2:
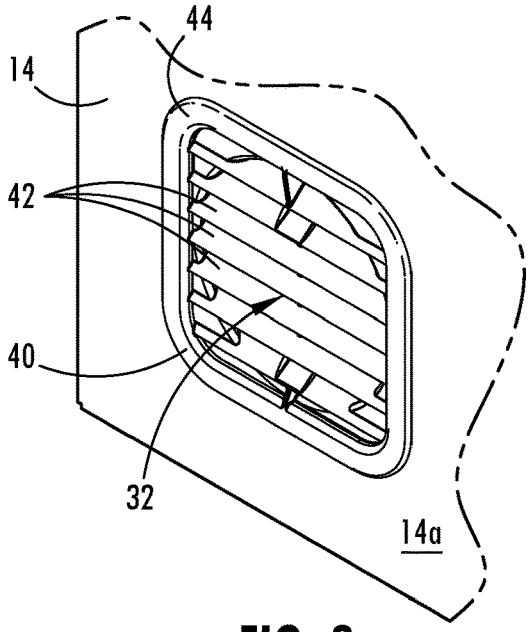
FIG. 2 is an enlarged perspective view of a region of the refrigeration appliance shown in FIG. 1 designated as II in FIG. 1.
Figure 3:
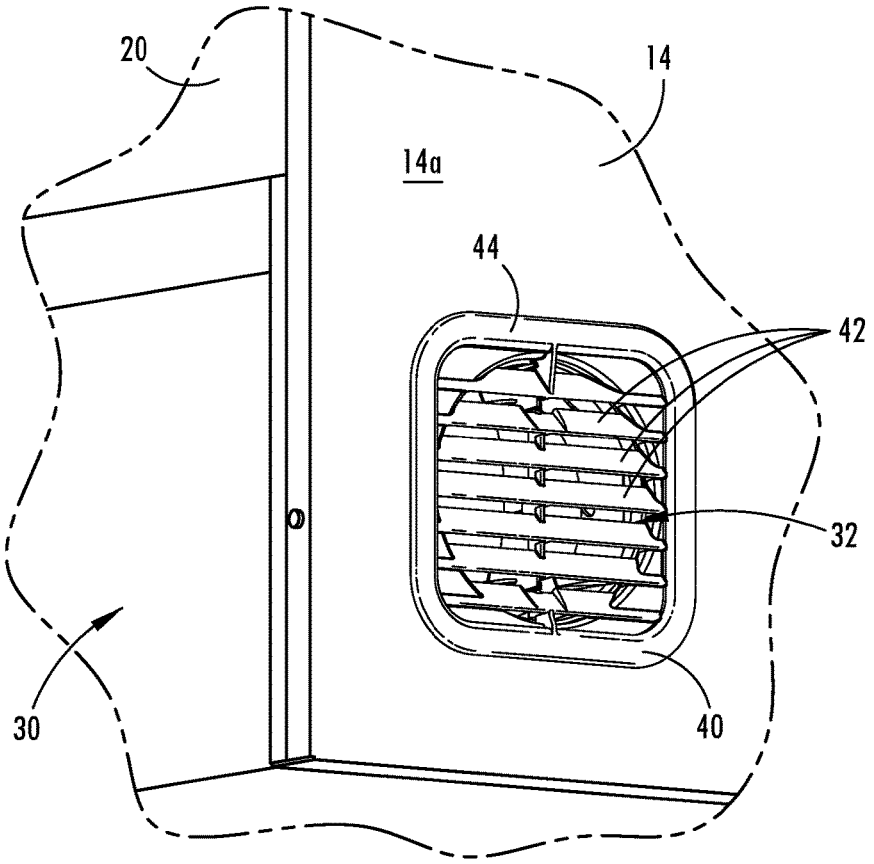
FIG. 3 is an enlarged perspective view of the region of the refrigeration appliance shown in FIG. 1 from a rear perspective.
Figure 4:
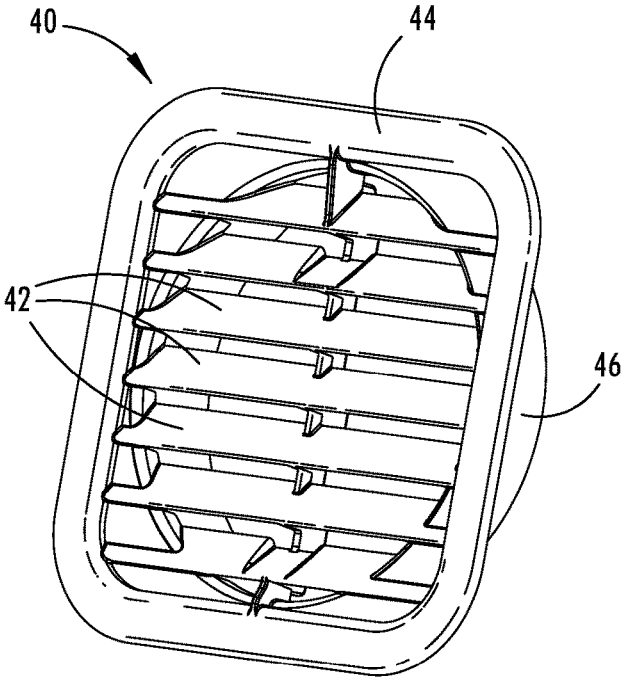
FIG. 4 is a front perspective view of the air vent shown in FIGS. 1-3.
Figure 5:
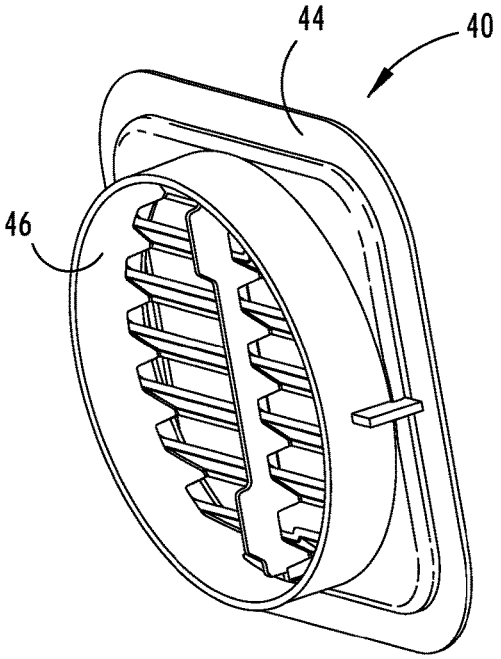
FIG. 5 is a rear perspective view of the air vent shown in FIGS. 1-4.
Figure 6:
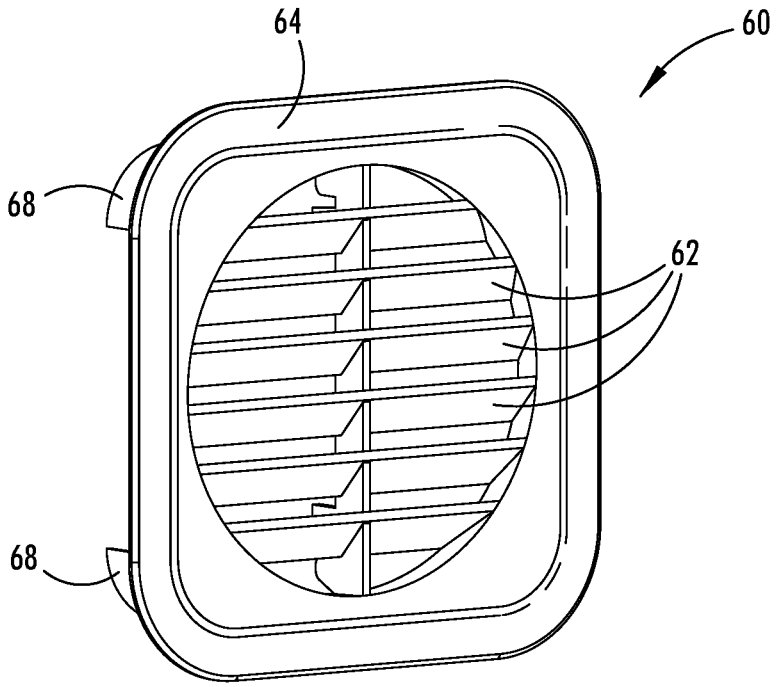
FIG. 6 is a front perspective view of a sound barrier of a first embodiment as used in the refrigeration appliance of FIG. 1.
Figure 7:
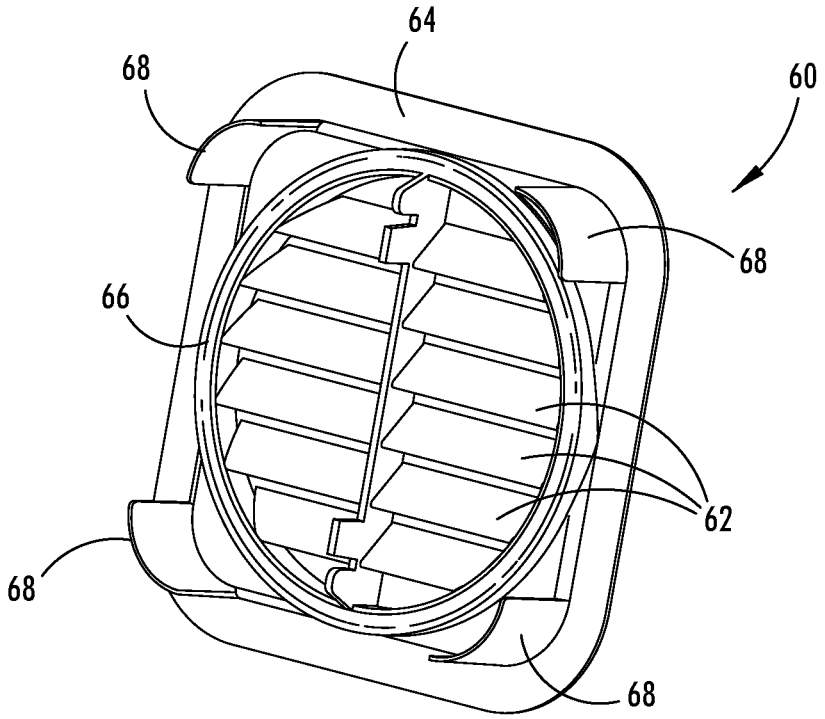
FIG. 7 is a rear perspective view of the sound barrier shown in FIG. 6.
Figure 8:
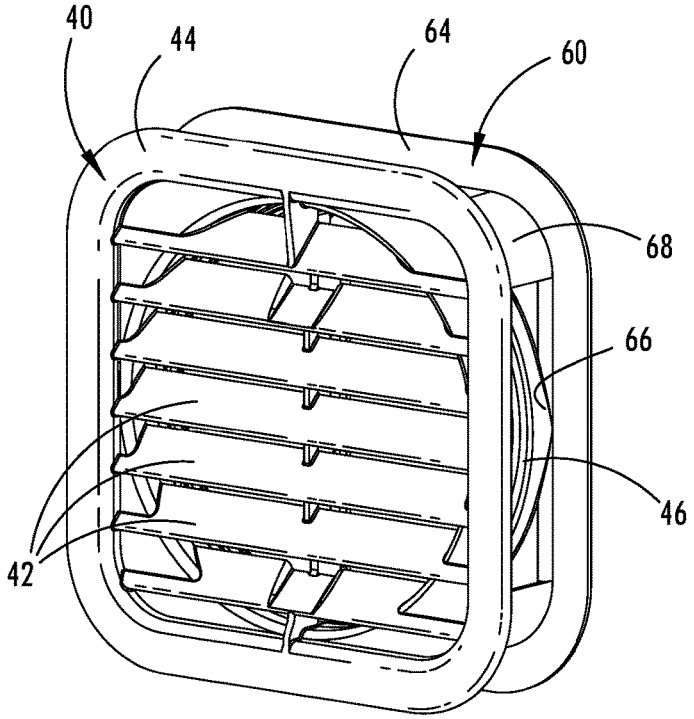
FIG. 8 is a front perspective view of the air vent and the sound barrier as positioned in the refrigeration appliance.

For purposes of description herein the terms "upper," "lower," "right," "left," "rear," "front," "vertical," "horizontal," and derivatives thereof shall relate to the refrigeration appliance as oriented in FIG. 1. However, it is to be understood that the refrigeration appliance may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

As noted above, this application pertains to refrigeration appliances. Such refrigeration appliances may include refrigerators and freezers. Typical refrigeration appliances have a machine compartment in which a compressor is located. Because compressors can become rather hot during operation, air is circulated through the machine compartment to cool the compressor. Accordingly, an air inlet and an air outlet are provided along with a fan that draws cool air in through the air inlet and expels the warmed air from the air outlet. It is known to provide both the air intake and the air outlet on the machine compartment cover, which is positioned at the back of the refrigeration appliance. Because the machine compartment cover is typically not insulated, it is relatively easy to form venting structures on the cover. One problem that arises with this venting arrangement is that the warm air exiting the air outlet can mix with the cooler air drawn into the air inlet such that the venting arrangement does not efficiently cool the machine compartment. Although it has been proposed to move the air inlet and air outlet to the sides of the refrigeration appliance to avoid this problem, the noise levels audible to a person in front of the refrigeration appliance are much greater than for those appliances having both vents in the back of the appliance, particularly when one or more vented sides of the appliance is not blocked by a wall or cabinets.

Referring to the first embodiment illustrated in FIG. 1, reference numeral 10 generally designates a refrigeration appliance. In the embodiment shown in FIG. 1, the refrigeration appliance 10 is a refrigerator having an insulated cabinet 12 in which at least one refrigerated storage compartment, which may include at least one refrigeration storage compartment 22 and an optional freezer storage compartment 24 are provided that are accessible via one or more doors 26*a* and 26*b* and/or drawer(s) 28. Refrigeration appliance 10 also includes a machine compartment 30 that may be provided at the bottom back portion of the appliance 10. Insulated cabinet 12 includes at least a first side wall 14, a second side wall 18, a back wall 20 disposed between the first and second side walls 14 and 18, and a top wall 16. First side wall 14 includes an exterior surface 14*a* and an interior surface 14*b*. Machine compartment 30 is positioned adjacent first side wall 14.

An aperture 32 is provided through first side wall 14 to allow air to flow from outside insulated cabinet 12 into machine compartment 30. An air vent 40 is provided at exterior surface 14*a* of first side wall 14 so as to cover aperture 32. Air vent 40 has a first set of louvers 42 arranged such that air may flow therebetween. A sound barrier 60 (FIGS. 6-10) is provided at interior surface 14*b* of first side wall 14 at aperture 32. Sound barrier 60 has a second set of louvers 62 arranged such that air may flow therebetween. As best shown in FIG. 10 and described further below, second set of louvers 62 of sound barrier 60 are positioned with respect to first set of louvers 42 of air vent 40 such that there is no mechanical access to components in machine compartment 30 through air vent 40 and sound barrier 60 from outside air vent 40. Further, second set of louvers 62 of sound barrier 60 are positioned with respect to first set of louvers 42 of air vent 40 such that sounds from within machine compartment 30 are dampened to reduce resulting sound levels outside air vent 40 while still allowing air to flow through air vent 40 and sound barrier 60 from outside insulated cabinet 12 into machine compartment 30.

Figure 9:
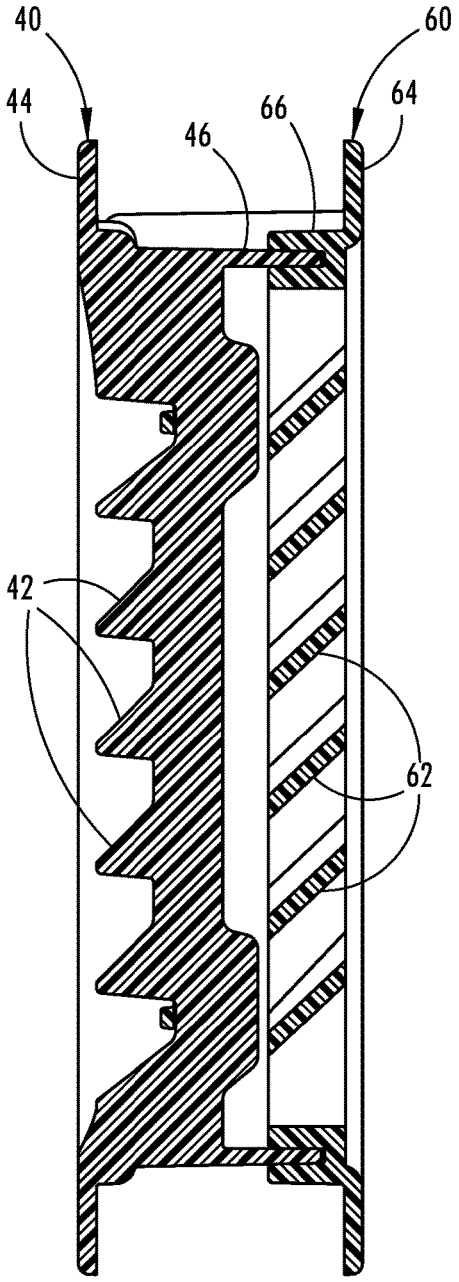
FIG. 9 is a cross-sectional view of the air vent and the sound barrier as positioned in the refrigeration appliance.
Figure 10:
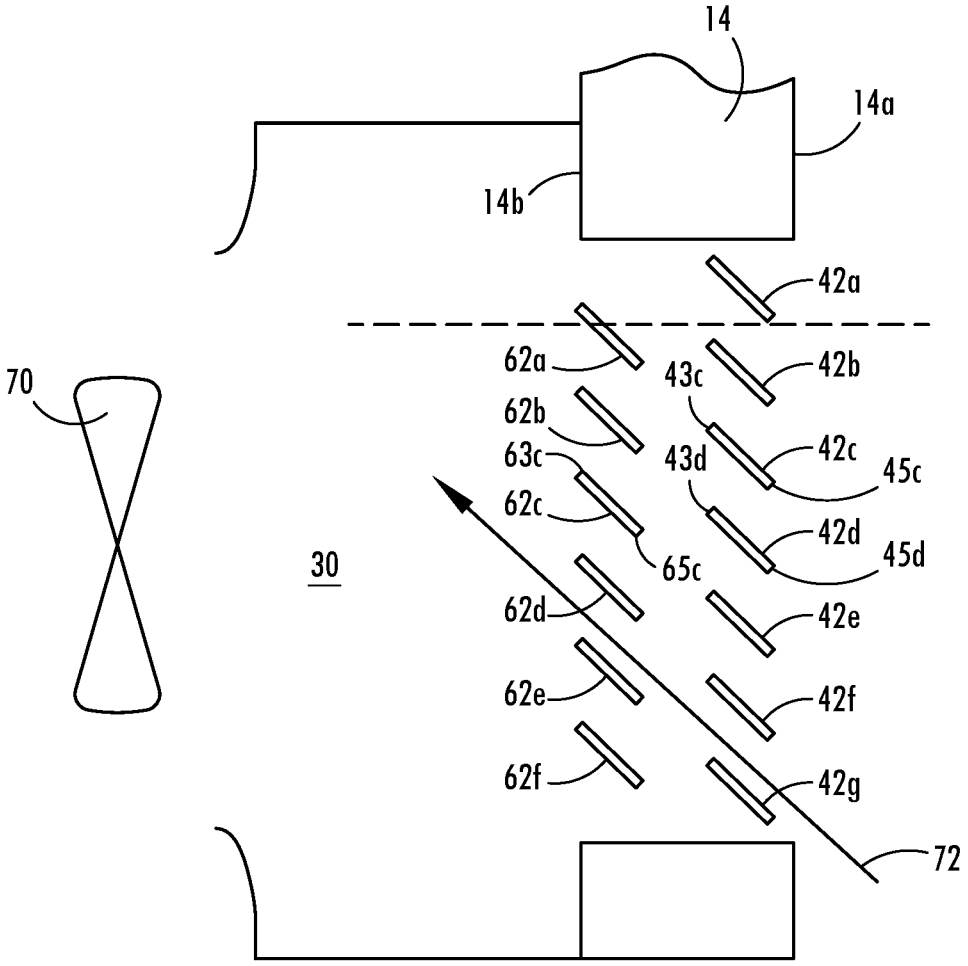
FIG. 10 is a cross-sectional schematic diagram illustrating the relationship between louvers of the air vent and the sound barrier as positioned in the refrigeration appliance.

As shown in FIGS. 9 and 10, louvers 42 of the first set of louvers extend horizontally and are angled at substantially the same angle. Similarly, louvers 62 of the second set of louvers extend horizontally and are angled at substantially the same angle and are angled at substantially the same angle as louvers 42 of the first set of louvers. For purposes of reference, as shown in FIG. 10, a plurality of louvers of the second set of louvers 62 each has an upper adjacent louver of the first set of louvers and a lower adjacent louver of the first set of louvers 42. Thus, for example, louver 62*c* of sound barrier 60 has an upper adjacent louver 42*c* of air vent 40 and a lower adjacent louver 42*d*. The plurality of louvers of the second set of louvers 62 each has a bottom edge positioned vertically lower than a top edge of the lower adjacent louver of the first set of louvers 42 and a top edge positioned vertically higher than a bottom edge of the upper adjacent louver of the first set of louvers 42. Thus, returning to the example, louver 62*c* has a bottom edge 63*c* and a top edge 65*c*, upper adjacent louver 42*c* has a bottom edge 43*c* and a top edge 45*c*, and lower adjacent louver 42*d* has a bottom edge 43*d* and a top edge 45*d*. In this example, bottom edge 63*c* of louver 62*c* is positioned vertically lower than top edge 45*d* of lower adjacent louver 42*d* and top edge 65*c* of louver 62*c* is positioned vertically higher than bottom edge 43*c* of upper adjacent louver 42*c*. By configuring the respective louvers in this manner, there is no mechanical access to components in machine compartment 30 through air vent 40 and sound barrier 60 from outside air vent 40. In other words, one cannot insert a straight object through the louvers 42 and 62 and touch a fan 70 provided in machine compartment 30. Moreover, one cannot insert a straight object through the louvers 42 and 62 in a horizontal plane.

As shown in FIGS. 2-10, louvers 42 of air vent 40 are angled downward and outward relative to the appliance 10. In other words, the top edges of louvers 42 are positioned closer to machine compartment 30 than their bottom edges. This prevents water or other fluid from flowing down exterior surface 14*a* of first side wall 14 into aperture 32. As also shown, louvers 62 of sound barrier 60 are angled downward and outward relative to the appliance 10. In other words, the top edges of louvers 62 are positioned closer to machine compartment 30 than their bottom edges. By arranging louvers 62 in a similar orientation as louvers 42, contiguous planar airflow channels 72 are defined between louvers 42 and between louvers 62 so that air flows through the planar airflow channels 72 at an angle relative to a horizontal plane into machine compartment 30. This allows good air flow to be maintained while blocking sound from exiting machine compartment 30.

Figure 11:
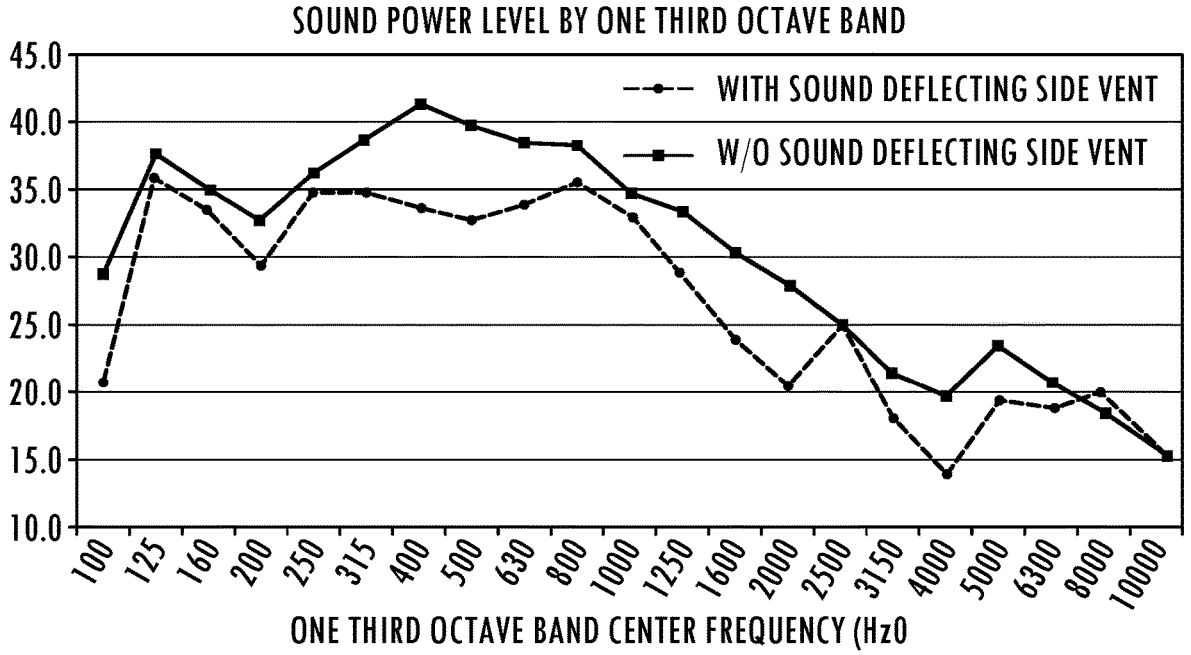
FIG. 11 is a graph of sound power level versus octave band illustrating the impact of the presence of the sound barrier shown in FIGS. 6-10.
Figure 12:
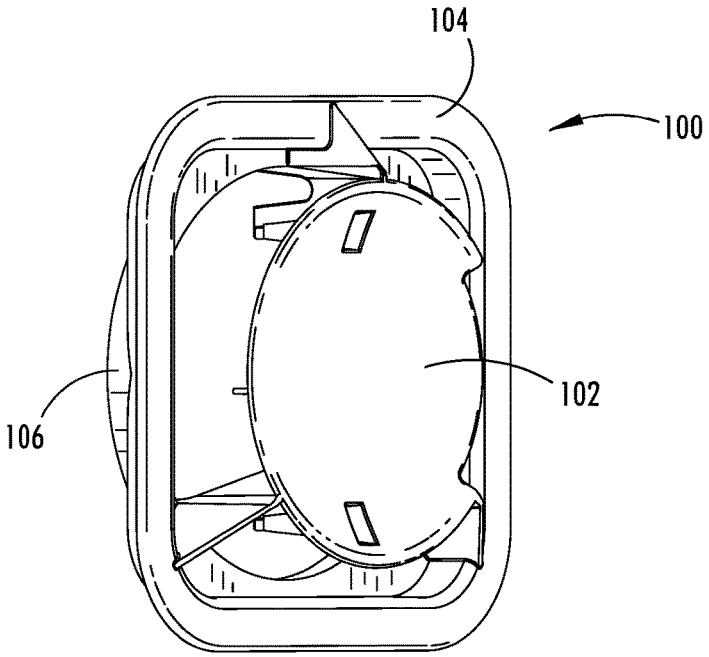
FIG. 12 is a perspective view of a sound barrier of a second embodiment as used in the refrigeration appliance of FIG. 1.
Figure 13:
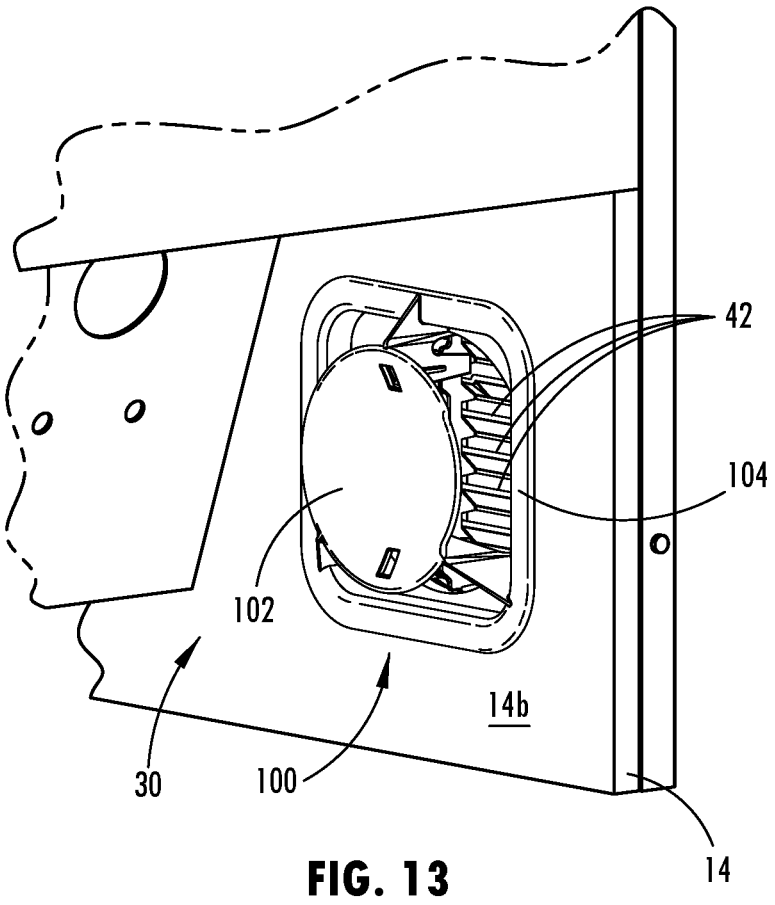
FIG. 13 is an enlarged perspective view of the sound barrier of FIG. 12 as shown from the inside of a machine compartment of a refrigeration appliance.
Figure 14:
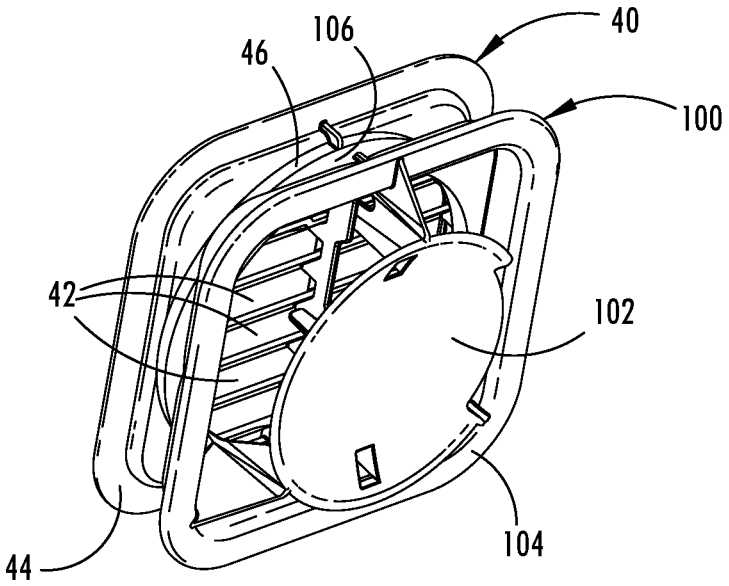
FIG. 14 is a perspective view of the air vent and the sound barrier as positioned in the refrigeration appliance.
Figure 15:
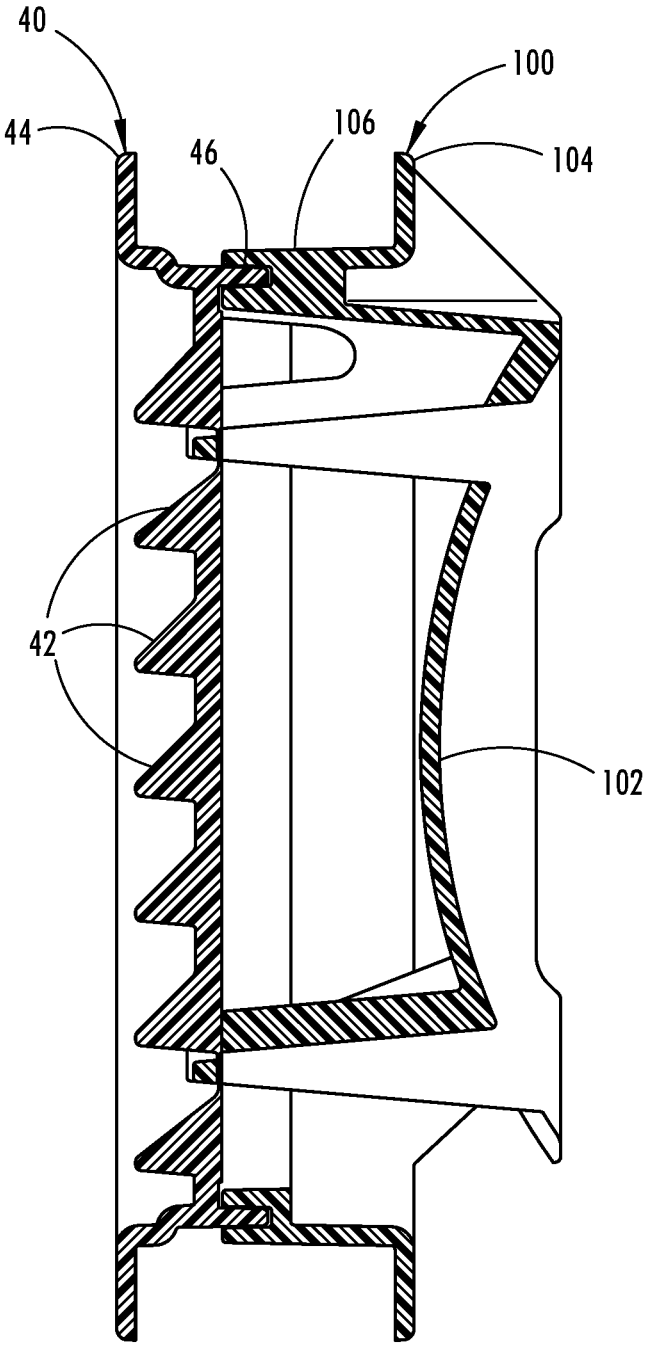
FIG. 15 is a cross-sectional view of the air vent and the sound barrier of FIG. 12 as positioned in the refrigeration appliance.

To demonstrate the sound reduction capability of the above described side air intake venting arrangement, sound power levels were measured at various octave bands both with and without sound barrier 60. In this way, the impact of the presence of sound barrier 60 could be ascertained. The results of the sound power level measurements are depicted in FIG. 11. As shown, the sound power level was reduced at most octave bands. Further, at some octave bands, sound barrier 60 provides a sound power reduction of at least 5 db(A).

Air vent 40 and sound barrier 60 may be configured to join and optionally interlock with one another. This ensures that the louvers 42 and 62 are oriented properly. An inner rim 46 of air vent 40 connects to an inner rim 66 of sound barrier 60 to form a lining for the edges of aperture 32.

As illustrated air vent 40 may include a flange 44 that extends outward from aperture 32 along exterior surface 14*a* of first side wall 14. Sound barrier 60 may include a flange 64 that extends outward from aperture 32 along interior surface 14*b* of first side wall 14. Sound barrier 60 may further include legs 68 to facilitate coupling to air vent 40 and/or first side wall 14.

A second embodiment is provided having a different sound barrier 100. Otherwise, the refrigeration appliance is similar to that shown in FIGS. 1 and 2. As shown in FIG. 1, refrigeration appliance 10 includes insulated cabinet 12 in which at least one refrigerated storage compartment 22 and/or 24 and a machine compartment 30 are provided. Insulated cabinet 12 includes at least first side wall 14, second side wall 18, back wall 20 disposed between first and second side walls 16 and 18, and top wall 16. First side wall 16 includes exterior surface 14*a* and interior surface 14*b*. Machine compartment 30 is positioned adjacent first side wall 14. Aperture 32 is provided through first side wall 14 to allow air to flow from outside insulated cabinet 12 into machine compartment 30. Air vent 40 is provided at exterior surface 14*a* of first side wall 14 so as to cover aperture 32.

As shown in FIGS. 12-15, a sound barrier 100 is provided at interior surface 14*b* of first side wall 14 at aperture 32. Sound barrier 100 has a dome 102 that is concave towards machine compartment 30 and convex towards air vent 40. Sound barrier 100 is arranged such that sounds from within machine compartment 30 are dampened to reduce resulting sound levels outside air vent 40 while still allowing air to flow through air vent 40 and sound barrier 100 from outside insulated cabinet 12 into machine compartment 30.

Air vent 40 and sound barrier 100 may be configured to join and optionally interlock with one another. An inner circular rim 46 of air vent 40 connects to an inner rim 106 of sound barrier 100 to form a lining for the edges of aperture 32. As illustrated, sound barrier 100 may include a flange 104 that extends outward from aperture 32 along interior surface 14*b* of first side wall 14.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms—couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, and the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A refrigeration appliance comprising:

an insulated cabinet in which at least one refrigerated storage compartment and a machine compartment are provided, said insulated cabinet including at least a first side wall, a second side wall and a back wall disposed between said first and second side walls, said first side wall including an exterior surface and an interior surface, said machine compartment being positioned adjacent said first side wall;

an aperture provided through said first side wall to allow air to flow from outside said insulated cabinet into said machine compartment;

an air vent provided at said exterior surface of said first side wall so as to cover said aperture; and a sound barrier provided at said interior surface of said first side wall at said aperture, said sound barrier having a dome that is concave towards said machine compartment and convex towards said air vent, said sound barrier arranged such that sounds from within said machine compartment are dampened to reduce resulting sound levels outside said air vent while still allowing air to flow through said air vent and said sound barrier from outside said insulated cabinet into said machine compartment.

2. The refrigeration appliance of claim 1, wherein said air vent and said sound barrier interlock with one another.

3. The refrigeration appliance of claim 2, wherein an inner rim of said air vent connects to an inner rim of said sound barrier to form a lining for the edges of said aperture.

4. The refrigeration appliance of claim 1, wherein said air vent includes a flange that extends outward from said aperture along said exterior surface of said first side wall.

5. The refrigeration appliance of claim 1, wherein said sound barrier includes a flange that extends outward from said aperture along said interior surface of said first side wall.

6. The refrigeration appliance of claim 1, wherein said air vent has a set of louvers arranged such that air may flow therebetween.

7. The refrigeration appliance of claim 6, wherein the louvers of said set of louvers extend horizontally.

8. The refrigeration appliance of claim 7, wherein each of the louvers of said set of louvers has a top edge and a bottom edge, wherein the top edge of the louvers of said set of louvers is positioned closer to said machine compartment than the bottom edge.

9. A refrigeration appliance comprising:

an insulated cabinet in which at least one refrigerated storage compartment and a machine compartment are provided, said insulated cabinet including at least a first side wall, a second side wall and a back wall disposed between said first and second side walls, said first side wall including an exterior surface and an interior surface, said machine compartment being positioned adjacent said first side wall;

an aperture provided through said first side wall to allow air to flow from outside said insulated cabinet into said machine compartment;

an air vent provided at said exterior surface of said first side wall so as to cover said aperture, wherein said air vent has a set of louvers arranged such that air may flow therebetween; and a sound barrier provided at said interior surface of said first side wall at said aperture, said sound barrier having a dome that is concave towards said machine compartment and convex towards said air vent, said sound barrier arranged such that sounds from within said machine compartment are dampened to reduce resulting sound levels outside said air vent while still allowing air to flow through said air vent and said sound barrier from outside said insulated cabinet into said machine compartment, wherein said air vent and said sound barrier interlock with one another.

10. The refrigeration appliance of claim 9, wherein an inner rim of said air vent connects to an inner rim of said sound barrier to form a lining for the edges of said aperture.

11. The refrigeration appliance of claim 9, wherein said air vent includes a flange that extends outward from said aperture along said exterior surface of said first side wall.

12. The refrigeration appliance of claim 9, wherein said sound barrier includes a flange that extends outward from said aperture along said interior surface of said first side wall.

13. The refrigeration appliance of claim 9, wherein the louvers of said set of louvers extend horizontally.

14. The refrigeration appliance of claim 13, wherein each of the louvers of said set of louvers has a top edge and a bottom edge, wherein the top edge of the louvers of said set of louvers is positioned closer to said machine compartment than the bottom edge.

15. A combined air vent and sound barrier for a refrigeration appliance wherein the refrigeration appliance comprises an insulated cabinet in which at least one refrigerated storage compartment and a machine compartment are provided, the insulated cabinet including at least a first side wall, a second side wall and a back wall disposed between the first and second side walls, the first side wall including an exterior surface and an interior surface, the machine compartment being positioned adjacent the first side wall, the insulated cabinet further including an aperture provided through the first side wall to allow air to flow from outside the insulated cabinet into the machine compartment, the combined air vent and sound barrier comprising:

an air vent configured for placement at the exterior surface of the first side wall so as to cover the aperture, wherein said air vent has a set of louvers arranged such that air may flow therebetween; and a sound barrier configured for placement at the interior surface of the first side wall at the aperture, said sound barrier having a dome that is concave towards the machine compartment and convex towards said air vent, said sound barrier arranged such that sounds from within the machine compartment are dampened to reduce resulting sound levels outside said air vent while still allowing air to flow through said air vent and said sound barrier from outside the insulated cabinet into the machine compartment, wherein said air vent and said sound barrier interlock with one another.

16. The combined air vent and sound barrier of claim 15, wherein an inner rim of said air vent connects to an inner rim of said sound barrier to form a lining for the edges of the aperture.

17. The combined air vent and sound barrier of claim 15, wherein said air vent includes a flange that extends outward from the aperture along the exterior surface of the first side wall.

18. The combined air vent and sound barrier of claim 15, wherein said sound barrier includes a flange that extends outward from the aperture along the interior surface of the first side wall.

19. The combined air vent and sound barrier of claim 15, wherein the louvers of said set of louvers extend horizontally.

20. The combined air vent and sound barrier of claim 19, wherein each of the louvers of said set of louvers has a top edge and a bottom edge, wherein the top edge of the louvers of said set of louvers is positioned closer to the machine compartment than the bottom edge.

* * * * *